US012146378B2

(12) United States Patent
Tucker et al.

(10) Patent No.: US 12,146,378 B2
(45) Date of Patent: Nov. 19, 2024

(54) DOWNHOLE PLUG DEPLOYMENT IN A SUBTERRANEAN WELL

(71) Applicant: THRU TUBING SOLUTIONS, INC., Newcastle, OK (US)

(72) Inventors: James C. Tucker, Springer, OK (US); Roger L. Schultz, Ninnekah, OK (US); Brett A. Fears, Mustang, OK (US); Gary P. Funkhouser, Moore, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/295,411

(22) Filed: Apr. 4, 2023

(65) Prior Publication Data

US 2024/0337167 A1 Oct. 10, 2024

(51) Int. Cl.
*E21B 33/12* (2006.01)

(52) U.S. Cl.
CPC ..... *E21B 33/12* (2013.01)

(58) Field of Classification Search
CPC ..... E21B 33/12; E21B 34/142
See application file for complete search history.

(56) References Cited

U.S. PATENT DOCUMENTS 4,881,599 A * 11/1989 Franco ..... E21B 33/124 166/284
5,881,826 A 3/1999 Brookey
6,123,159 A 9/2000 Brookey et al.
6,156,708 A 12/2000 Brookey et al.
6,390,208 B1 5/2002 Brookey
6,422,326 B1 7/2002 Brookey et al.
6,716,797 B2 4/2004 Brookey
6,739,414 B2 5/2004 Brookey et al.
6,770,601 B1 8/2004 Brookey
10,760,370 B2 9/2020 Jones
10,858,905 B2 * 12/2020 Randle ..... E21B 33/1208
11,536,113 B1 * 12/2022 Alshaikh ..... E21B 47/138
(Continued)

OTHER PUBLICATIONS

Boyd D. Schaneman, et al, Aphrons Technology—A Solution, American Association of Drilling Engineers AADE-03-NTCE-41, dated 2003, 7 pages.

(Continued)

*Primary Examiner* — Steven A MacDonald
(74) *Attorney, Agent, or Firm* — Smith IP Services, P.C.

(57) ABSTRACT

A method of dispensing a plug can include deploying the plug into a tubular string including a plug dispenser tool, and applying a pressure differential across the plug, thereby discharging the plug into an annulus surrounding the plug dispenser tool. A plug dispenser tool can include an outer housing having a plug discharge port that provides fluid communication between an exterior of the outer housing and a flow passage extending longitudinally through the plug dispenser tool, and a piston slidably disposed in the outer housing between a closed position in which the piston blocks fluid flow through the plug discharge port, and an open position in which fluid flow through the plug discharge port is permitted. A system can include a plug dispenser tool configured to discharge the plug into an annulus surrounding the plug dispenser tool in response to a predetermined pressure differential applied across the plug.

20 Claims, 8 Drawing Sheets

(56) References Cited

U.S. PATENT DOCUMENTS

| | | | | |
|---|---|---|---|---|
| 11,725,498 | B2 * | 8/2023 | Alshaikh | E21B 47/138 166/250.11 |
| 11,828,163 | B2 * | 11/2023 | Alshaikh | E21B 34/142 |
| 11,898,436 | B2 * | 2/2024 | Alshaikh | E21B 47/01 |
| 2004/0108109 | A1 * | 6/2004 | Allamon | E21B 23/04 166/243 |
| 2015/0068771 | A1 * | 3/2015 | Richards | E21B 23/0413 166/386 |
| 2015/0068772 | A1 * | 3/2015 | Richards | E21B 23/0413 166/386 |
| 2015/0345256 | A1 * | 12/2015 | Tulloch | E21B 33/12 175/263 |
| 2017/0362913 | A1 * | 12/2017 | Randle | E21B 33/1208 |
| 2019/0257172 | A1 * | 8/2019 | Watson | E21B 33/068 |
| 2020/0232302 | A1 * | 7/2020 | Budde | E21B 34/14 |
| 2021/0172278 | A1 * | 6/2021 | Randle | E21B 33/1208 |
| 2022/0228456 | A1 * | 7/2022 | Watson | E21B 33/068 |
| 2023/0184090 | A1 * | 6/2023 | Alshaikh | E21B 34/142 166/250.11 |
| 2023/0184091 | A1 * | 6/2023 | Alshaikh | E21B 47/01 166/250.11 |
| 2023/0184092 | A1 * | 6/2023 | Alshaikh | E21B 47/138 166/250.11 |

OTHER PUBLICATIONS

Colter Cookson, Advanced Diverters Speed Operations, The American Oil & Gas Reporter, dated Mar. 2020, 11 pages.

David Peurifoy, et al, Utilizing Low-Density Mud Systems . . . , SPE-209991-MS, dated Oct. 3-5, 2022, 12 pages.

Fred Growcock, Enhanced Wellbore Stabilization and Reservoir Productivity with Aphron Drilling Fluid Technology, Jul. 2004, 45 pages.

Frederick B. Growcock, et al, Applications of Novel Aphron Drilling Fluids, American Association of Drilling Engineers AADE-04-DF-HO-18, dated Apr. 6-7, 2004, 6 pages.

Larry Eoff, et al, Polymer Treatment Controls Fluid Loss While Maintaining Hydrocarbon Flow, Journal of Petroleum Technology, dated Jul. 2009, 3 pages.

LO-Gard(r) Service Reduces Lost Circulation in Horizontal Plug Cleanout, Halliburton case study, dated 2016, 2 pages.

Perf Frac Diverter product brochure, Nine Energy Service, dated Dec. 18, 2020, 1 page.

Tatiana Hoff, et al, Drilling Fluid Selection . . . , American Association of Drilling Engineers AADE-05-NTCE-73, dated Apr. 5-7, 2005, 6 pages.

* cited by examiner

DOWNHOLE PLUG DEPLOYMENT IN A SUBTERRANEAN WELL

BACKGROUND

This disclosure relates generally to equipment utilized and operations performed in conjunction with a subterranean well and, in examples described below, more particularly provides for effective dispensing of plugs downhole.

Ball sealers, particulate diverter material and other types of plugging devices are typically deployed into a well from a surface location. The plugging devices can be carried with fluid flow to perforations or other flow paths between the wellbore and a surrounding earth formation.

Therefore, it will be readily appreciated that improvements are continually needed in the art of deploying plugging devices in a well. Such improvements may be used for plugging flow paths between a wellbore and a formation, or they may be used for other purposes (such as, plugging openings in seats, valve sleeves, actuators, etc.).

DETAILED DESCRIPTION

Figure 1:
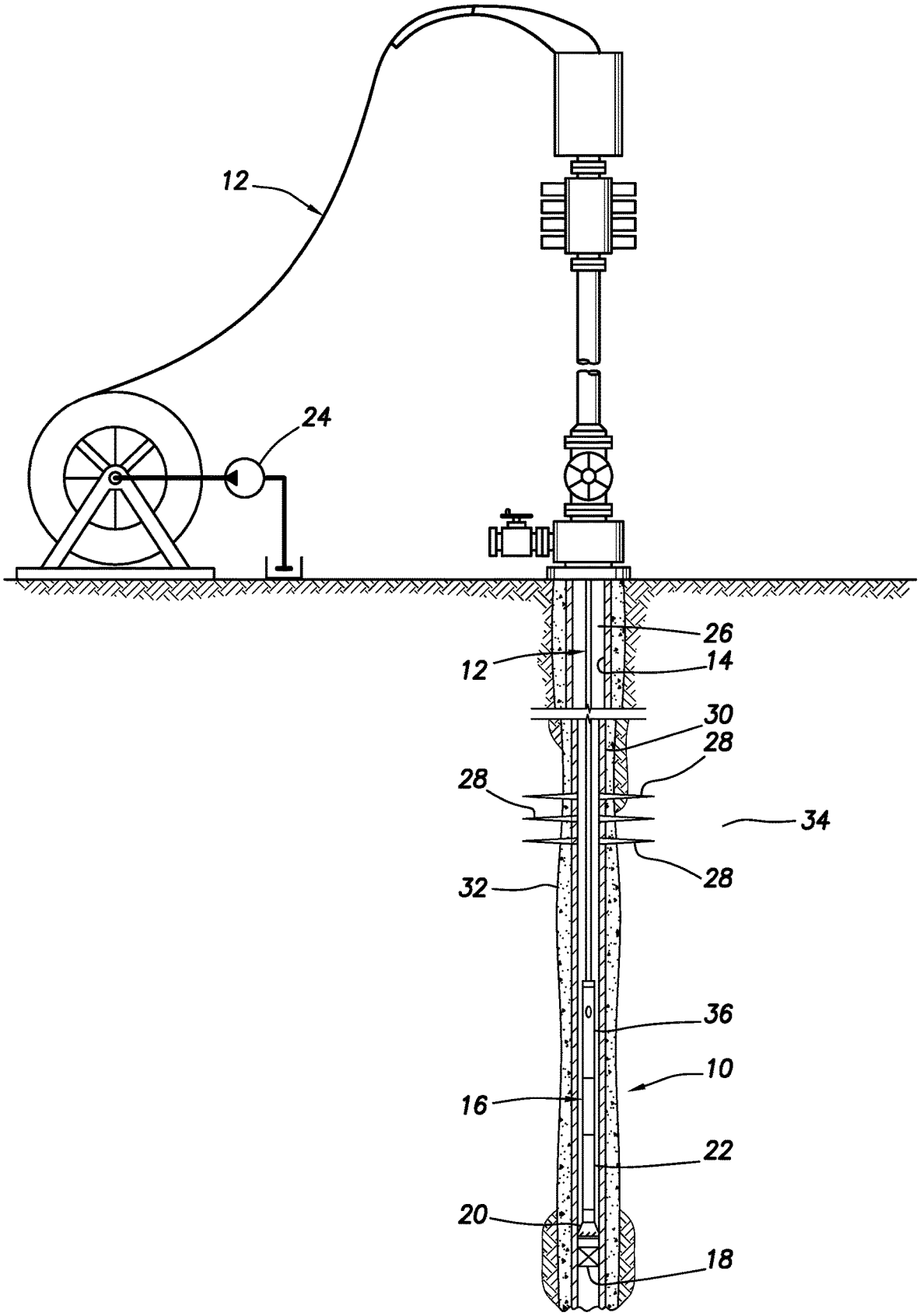
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is deployed into a wellbore 14. The tubular string 12 is of the type known to those skilled in the art as a coiled tubing string, but other types of tubular strings may be used in other examples.

Connected at a distal end of the tubular string 12 is a bottom hole assembly 16. In this example, the bottom hole assembly 16 is used to drill or mill out a bridge plug 18 previously set in the wellbore 14. For this purpose, the bottom hole assembly 16 includes a drill bit or mill 20 connected at a distal end of the bottom hole assembly. However, it should be clearly understood that the principles of this disclosure are not limited to any particular purpose for a bottom hole assembly deployed into a wellbore with a tubular string, and are not limited to any particular components or combination of components in the bottom hole assembly. In some examples, the bottom hole assembly 16 could include just the drill bit or mill 20, as well as the plug dispenser tool 36 described below.

The FIG. 1 bottom hole assembly 16 includes an optional fluid motor 22 (such as, a turbine or a Moineau-type positive displacement fluid motor) for rotating the drill bit or mill 20 in response to fluid flow through the fluid motor. For example, a pump 24 can be connected to a proximal end of the tubular string 12 (e.g., at or near the earth's surface). The pump 24 can flow a suitable fluid through the tubular string 12, the fluid can then be discharged into the wellbore 14 (such as, via nozzles in the drill bit or mill 20), and return to the surface via an annulus 26 formed radially between the tubular string and the wellbore.

As depicted in FIG. 1, perforations 28 are formed through casing 30 and cement 32 lining the wellbore 14. The perforations 28 permit fluid communication between the wellbore 14 and an earth formation 34 surrounding the wellbore. In other examples, fluid communication could be provided by features other than perforations (such as, a casing valve, an open hole or uncased section of the wellbore, etc.).

In some situations, it may be desired to limit pressure applied to the formation 34 via the perforations 28. For example, the formation 34 may be under-pressurized, so that it can be readily fractured if excessive pressure is applied to the formation. However, in drilling and milling operations, a sufficient return flow rate through the annulus 26 should be maintained in order to suspend and flush cuttings out of the wellbore 14. The flow rate level needed for drilling or milling operations can result in excessive pressure being applied to the formation 34.

In such situations, it would be desirable to be able to dispense one or more plugs into the wellbore 14 to block flow through the perforations 28. In this manner, the fluid flow through the annulus 26 during drilling or milling operations will not result in excessive pressure being applied to the formation 34.

Note that the scope of this disclosure is not limited to preventing pressure transmission to a formation in drilling or milling operations. A plug may be discharged into a wellbore for any purpose (for example, to plug an opening in a well tool, to activate a downhole actuator, etc.) in keeping with the principles of this disclosure. As used herein, the term "plug" can encompass ball sealers, darts, particulate diverter material and other types of plugging devices.

In the FIG. 1 example, the bottom hole assembly 16 includes a plug dispenser tool 36. The plug dispenser tool 36 is connected at or near an upper or proximal end of the bottom hole assembly 16 in this example, for optimal discharge of a plug (not shown in FIG. 1) into the annulus 26 upstream of the perforations 28 (circulating fluid flow in the FIG. 1 example would typically be in an upward direction through the annulus). The fluid flow through the annulus 26 will deliver the plug to one of the perforations 28. Since, as described more fully below, the plug is deployed into the plug dispenser tool 36 from the surface, the plug dispenser tool is preferably connected above the fluid motor 22 and any other restricted flow path tools in the bottom hole assembly 16 in this example.

When it is desired to block flow through the perforations 28, a plug may be deployed into the tubular string 12 using any suitable equipment and techniques. For example, suitable plug deployment apparatus and methods are described in US publication nos. 2022/0228456 and 2019/0257172, the entire disclosures of which are incorporated herein by this reference for all purposes.

After the plug is deployed into the tubular string 12, the plug will eventually enter the plug dispenser tool 36. The plug will block flow through a flow passage in the plug dispenser tool 36 and thereby allow a pressure differential to be created across the plug in the tool. When the pressure differential reaches a predetermined level, the plug will be discharged from the tool 36 into the annulus 26 surrounding the tool.

Figure 2:
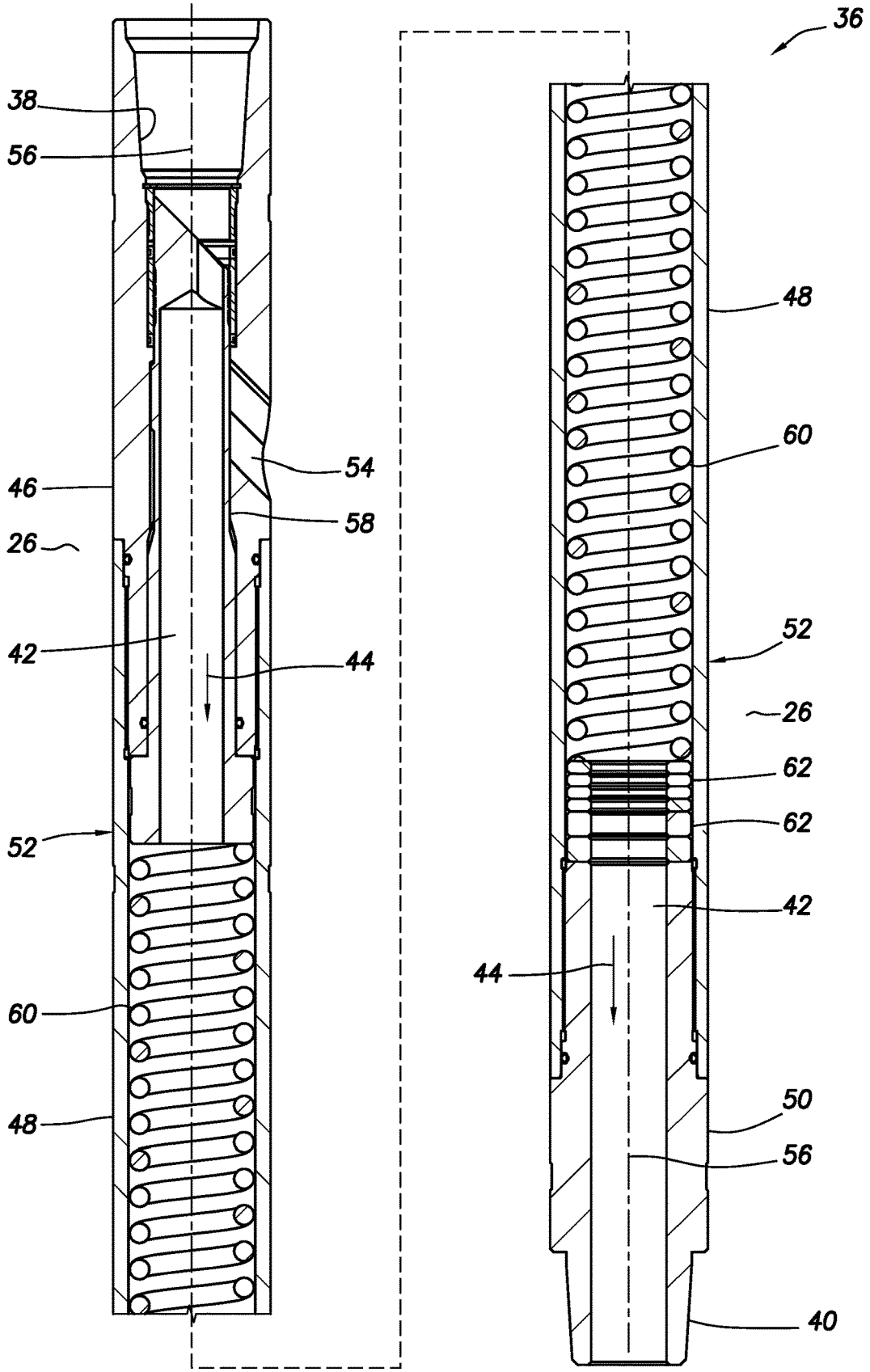
FIG. 2 is a representative cross-sectional view of an example of a plug dispenser tool that may be used in the FIG. 1 system and method.

Referring additionally now to FIG. 2, a cross-sectional view of an example of the plug dispenser tool 36 is representatively illustrated. The FIG. 2 plug dispenser tool 36 may be used in the system 10 and method of FIG. 1, or it may be used with other systems and methods. For convenience, the plug dispenser tool 36 is described below as it may be used in the FIG. 1 system 10 and method.

In the FIG. 2 example, the plug dispenser tool 36 includes upper and lower threaded connections 38, 40 for connecting the tool 36 in a tubular string (such as, in the FIG. 1 bottom hole assembly 16). A flow passage 42 extends longitudinally through the tool 36. Fluid flow 44 can pass through the tool 36 via the flow passage 42 between the connections 38, 40.

Several generally tubular outer housings 46, 48, 50 are connected together to form an outer housing assembly 52 of the tool 36. In other examples, more or fewer outer housings may be provided (such as, by integrally or separately forming various ones of the outer housings).

The upper outer housing 46 has a plug discharge port 54 formed through a side wall. As depicted in FIG. 2, the plug discharge port 54 is inclined downward and outward relative to a central longitudinal axis 56 of the plug dispenser tool 36. This inclination helps to guide the plug (not shown in FIG. 2) from the flow passage 42 to an exterior of the tool 36 (the annulus 26 in the FIG. 1 system) when the plug is discharged from the tool. In other examples, the plug discharge port 54 may not be inclined downward and outward.

In the closed configuration depicted in FIG. 2, an annular or sleeve-type piston 58 blocks flow through the plug discharge port 54. The piston 58 is slidingly and sealingly received in the outer housing 46.

In this example, the piston 58 is biased upward to its closed position by a biasing device 60 disposed in the intermediate outer housing 48. As depicted in FIG. 2, the biasing device 60 comprises a coiled compression spring, but other types of biasing devices (such as, a compressed gas, an elastomer, a compressible liquid, etc.) may be used in other examples.

A number of spacers 62 can be installed in the outer housing 48 to further compress the biasing device 60 between the lower outer housing 50 and the piston 58. A biasing force exerted against the piston 58 by the biasing device 60 can be adjusted by varying a number and/or size of the spacers 62.

When the piston 58 is displaced downward against the biasing force exerted by the biasing device 60, as described more fully below, eventually the plug discharge port 54 will be unblocked, thereby allowing a plug to be discharged from the flow passage 42 to the annulus 26, and permitting fluid communication between the flow passage and the annulus.

Figure 3:
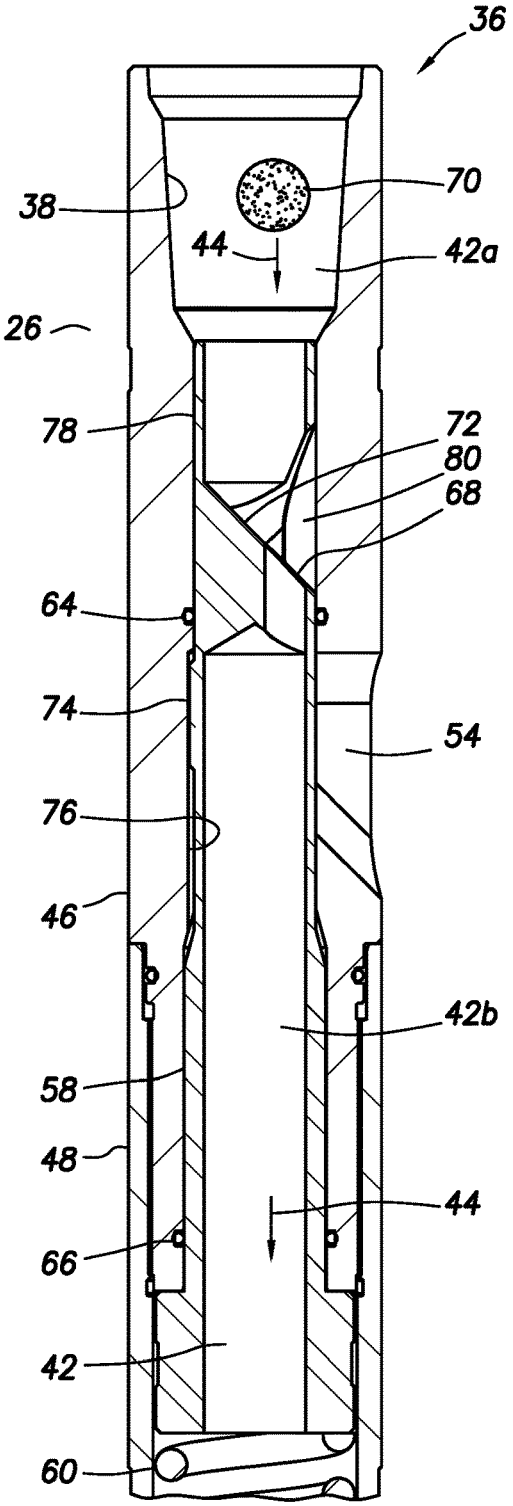
FIG. 3 is a representative cross-sectional view of an example of a dispenser portion of the plug dispenser tool.

Referring additionally now to FIG. 3, a cross-sectional view of a first example of a dispenser section of the plug dispenser tool 36 is representatively illustrated. In this example, the dispenser section consists generally of the outer housing 46 and the piston 58.

As depicted in FIG. 3, the piston 58 is in its upper closed position. In this position, the piston 58 blocks fluid flow through the plug discharge port 54 between the flow passage 42 and the annulus 26. Seals 64, 66 seal between an exterior of the piston 58 and an interior of the outer housing 46 on opposite longitudinal sides of the plug discharge port 54.

In the FIG. 3 example, a sealing diameter of the upper seal 64 is smaller than a sealing diameter of the lower seal 66. In this manner, a pressure differential from the flow passage 42 to the annulus 26 (which is typically the situation when circulating fluid through a tubular string in a well) will result in a force that biases the piston 58 toward its closed position.

The flow passage 42 extends longitudinally through the piston 58. A seat 68 is formed on the piston 58, so that the seat surrounds or encircles the flow passage 42. The seat 68 is configured to contact and sealingly engage a plug 70 deployed into a section 42*a* of the flow passage 42 above or upstream of the seat. The seat 68 can be configured to cooperatively engage a selected type of plug 70 (such as, spherical, dart-shaped, etc.).

The plug 70 is depicted in FIG. 3 as being generally round or spherical, similar to a conventional "frac ball" or "diverter ball." In other examples, other plug shapes (such as, cylindrical, conical, dart-shaped, etc.) may be used. Some examples of suitable plugs are described in U.S. Pat. No. 10,851,615, the entire disclosure of which is incorporated herein by this reference for all purposes.

An inclined surface 72 formed on the piston 58 surrounds the seat 68. When the piston 58 is in its open position, as described more fully below, the inclined surface 72 will face toward the plug discharge port 54. The inclination of the surface 72 will help to urge the plug 70 to displace outward through the port 54 with fluid flow out of the port.

The inclined surface 72 is maintained in its orientation facing toward the port 54 by preventing or substantially limiting rotation of the piston 58 relative to the outer housing 46. In the FIG. 3 example, a longitudinally extending key or spline 74 formed on the piston 58 is slidably engaged in a longitudinally extending groove 76 formed in the outer housing 46.

In other examples, the surface 72 (and the seat 68) may not be inclined. In that case, rotation of the piston 58 relative to the outer housing 46 may not be prevented or limited. In some examples, the seat 68 may be positioned at a central axis of the piston 58 (instead of being laterally offset from the central axis as depicted in FIG. 3).

In the FIG. 3 example, a generally tubular plug guide 78 is formed at an upper end of the piston 58. The plug guide 78 is shaped to guide the plug 70 to displace with the fluid flow 44 from the upper flow passage section 42*a* into the piston 58 and into engagement with the seat 68. An opening 80 in a side wall of the plug guide 78 will allow the plug 70 to displace outward through the plug discharge port 54 when the piston 58 is displaced downward to its open position.

Figure 4:
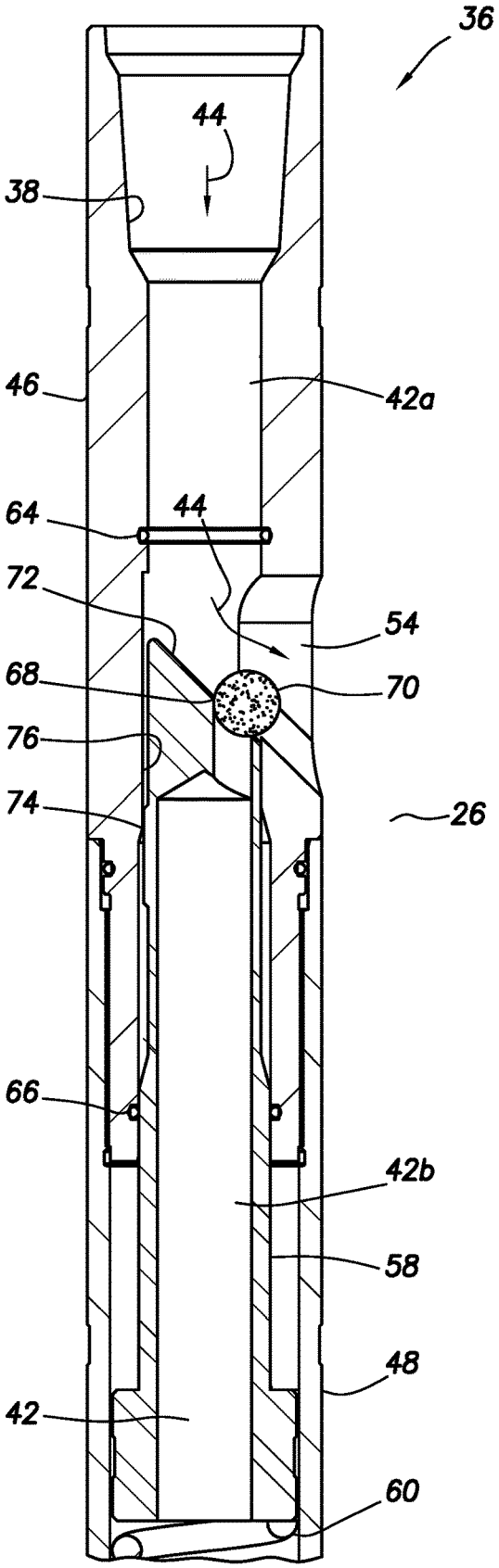
FIG. 4 is a representative cross-sectional view of another example of the dispenser portion.

Referring additionally now to FIG. 4, another example of the plug dispenser section of the plug dispenser tool 36 is representatively illustrated. The FIG. 4 example is similar in many respects to the FIG. 3 example, and so the same reference numerals are used in FIG. 4 to indicate similar components.

The plug dispenser tool 36 is depicted in an open configuration in FIG. 4. The piston 58 has been displaced downward against the biasing force exerted by the biasing device 60, so that the plug discharge port 54 is no longer blocked by the piston.

The plug 70 can now be discharged with the fluid flow 44 from the flow passage 42 to the annulus 26 via the port 54. The downward and outward inclination of the seat 68 and surrounding surface 72 toward the port 54 facilitates the displacement of the plug 70 with the fluid flow 44.

To displace the piston 58 downward to its open position, a pressure differential is applied across the plug 70 after it has engaged the seat 68 and blocked the fluid flow 44 through the flow passage 42 in the piston. For example, increased pressure can be applied to the upper flow passage section 42*a* (e.g., using the FIG. 1 pump 24) after the plug 70 has engaged the seat 68. Note that it is not necessary for the plug 70 to completely prevent fluid flow from the upper flow passage section 42*a* to the lower flow passage section 42*b*, since the pressure differential can be applied even if there is some leakage between the plug and the seat 68.

The pressure differential applied across the plug 70 (and piston 58) overcomes the biasing force exerted by the biasing device 60. The pressure differential required to displace the piston 58 to its open position can be adjusted by varying the biasing force exerted by the biasing device 60, as discussed above.

Note that the FIG. 4 piston 58 does not include the plug guide 78 of the FIG. 3 piston. However, the plug guide 78 can be included with the FIG. 4 piston 58 in other examples.

Figure 5:
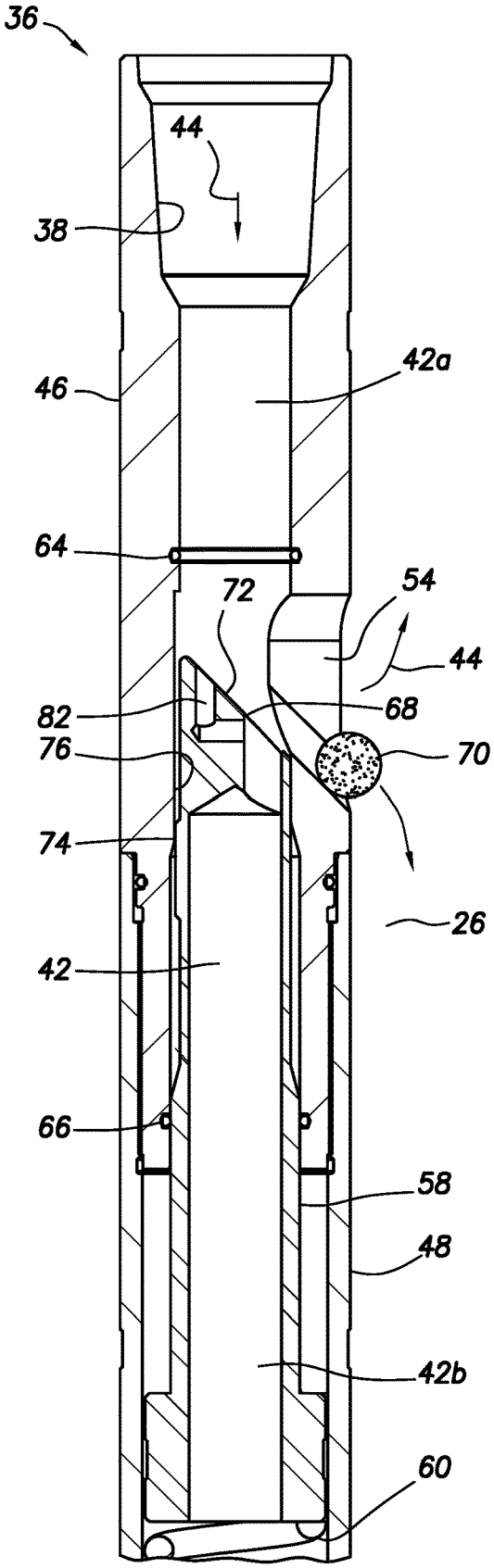
FIG. 5 is a representative cross-sectional view of another example of the dispenser portion.

Referring additionally now to FIG. 5, another example of the plug dispenser section of the plug dispenser tool 36 is representatively illustrated. The FIG. 5 example is similar in many respects to the FIGS. 3 & 4 examples, and so the same reference numerals are used in FIG. 5 to indicate similar components.

As depicted in FIG. 5, the piston 58 has been displaced to its open position by application of a sufficient pressure differential from the upper flow passage section 42*a* to the lower flow passage section 42*b* after the plug 70 has engaged the seat 68. The plug 70 has then displaced outward through the port 54 with the fluid flow 44.

The plug 70 may initially exit the port 54 into the annulus 26 in a downward direction, but the fluid flow 44 will eventually carry the plug 70 upward through the annulus to the perforations 28 in the FIG. 1 system 10 and method. In other examples (such as, if an opening to be plugged is in a downward direction from the plug dispenser tool 36), the plug 70 may displace in other directions after it exits the port 54.

When the piston 58 displaces to its open position, the pressure differential is still applied across the plug 70. This could make it difficult to disengage the plug 70 from the seat 68 with the fluid flow 44. The FIG. 5 dispenser section includes a feature that functions to reduce the pressure differential across the plug 70 and seat 68, so that the plug can be more readily disengaged from the seat.

Specifically, a bypass flow path 82 is formed in the piston 58. The bypass flow path 82 permits limited or restricted fluid communication between the upper and lower flow passage sections 42*a,b* when the plug 70 is engaged with the seat 68. The bypass flow path 82 can be dimensioned and configured so that, even though the bypass flow path allows fluid flow between the flow passage sections 42*a,b* when the plug 70 is engaged with the seat 68, a sufficient pressure differential can still be applied across the plug to overcome the biasing force exerted by the biasing device 60 (for example, by appropriately increasing a flow rate of the fluid flow 44).

Figure 6:
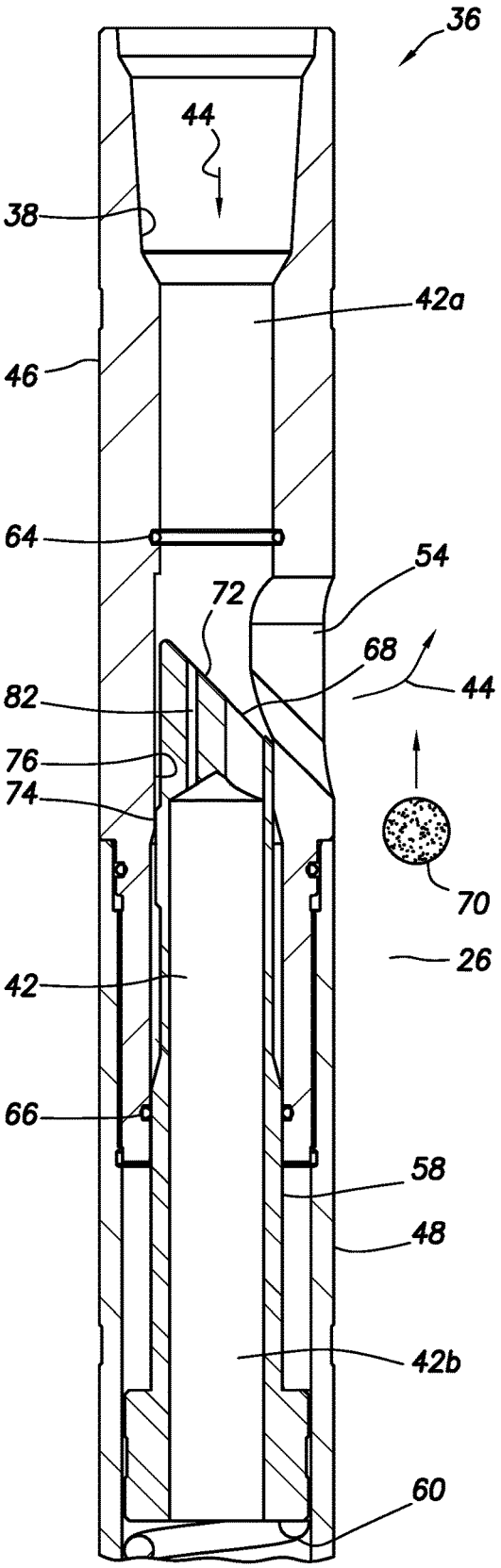
FIG. 6 is a representative cross-sectional view of another example of the dispenser portion.

Referring additionally now to FIG. 6, another example of the plug dispenser section of the plug dispenser tool 36 is representatively illustrated. The FIG. 6 example is substantially similar to the FIG. 5 example. However, in the FIG. 6 example, the bypass flow path 82 is formed axially straight through the upper end of the piston 58. Although only one bypass flow path 82 is depicted in FIG. 6, multiple bypass flow paths may be provided in other examples.

Figure 7:
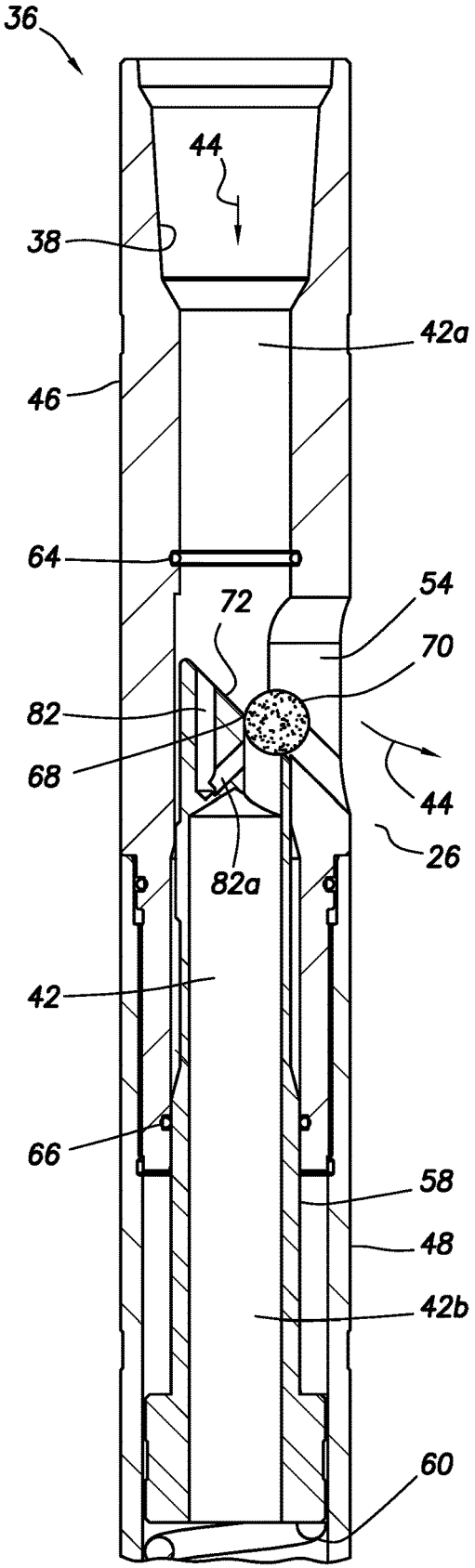
FIG. 7 is a representative cross-sectional view of another example of the dispenser portion.

Referring additionally now to FIG. 7, another example of the plug dispenser section of the plug dispenser tool 36 is representatively illustrated. The FIG. 7 example is substantially similar to the FIG. 5 example. However, the bypass flow path 82 in the FIG. 7 example includes an upwardly inclined section 82*a* directed toward a lower portion of the plug 70 when the plug is engaged with the seat 68. The upwardly inclined section 82*a* directs the fluid flow 44 to the lower portion of the plug 70 to help disengage the plug from the seat 68 when the piston 58 is in its open position.

Figure 8:
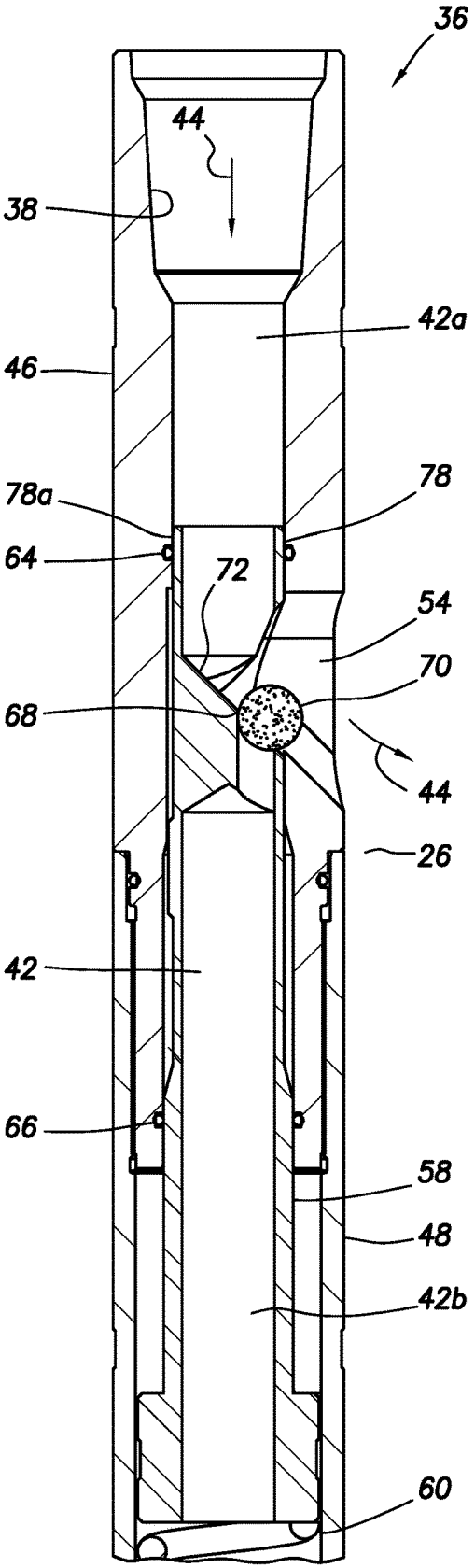
FIG. 8 is a representative cross-sectional view of another example of the dispenser portion.

Referring additionally now to FIG. 8, the FIG. 3 example of the plug dispenser section of the plug dispenser tool 36 is representatively illustrated in an open configuration. An upper tubular portion 78*a* of the plug guide 78 is positioned between the seal 64 and the flow passage 42 when the piston 58 displaces to its open position. Thus, it will be appreciated that the plug guide 78 is useful to prevent damage to, or dislodgment of, the upper seal 64 when the piston 58 is in its open position. The plug guide 78 may be used with any of the other examples of the plug dispenser section described herein.

Figure 9:
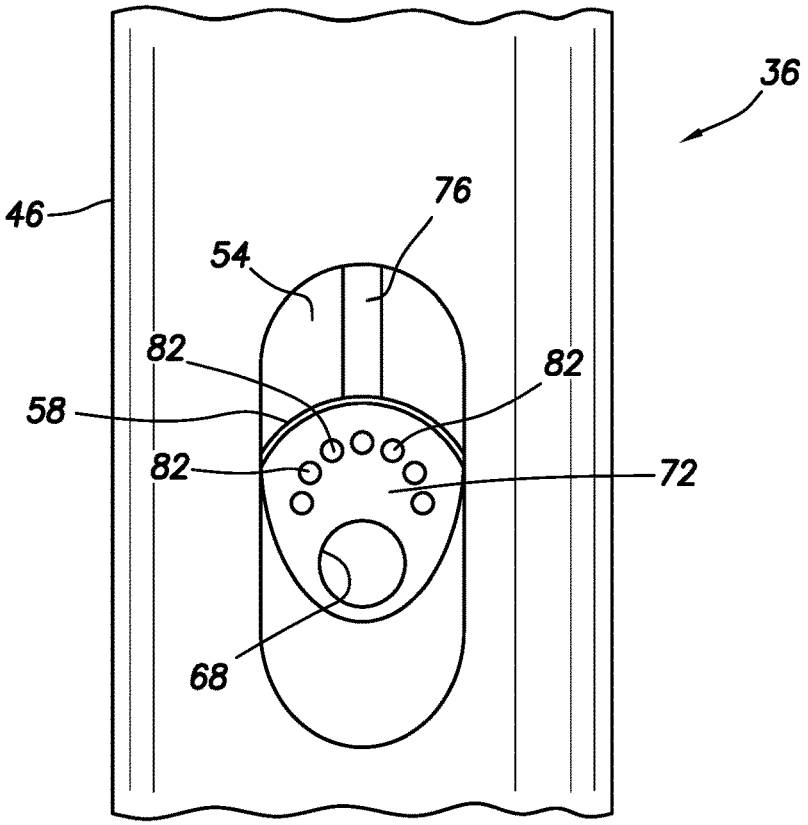
FIG. 9 is a representative side view of an example of a plug discharge port of the plug dispenser tool.
Figure 10:
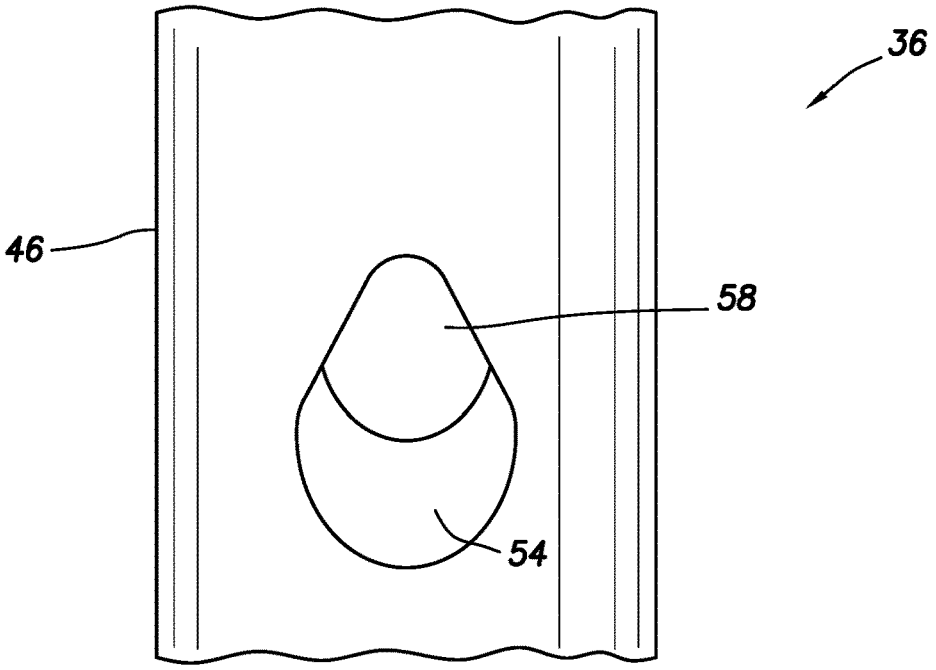
FIG. 10 is a representative side view of another example of the plug discharge port.

Referring additionally now to FIGS. 9 & 10, examples of a section of the plug dispenser tool 36 comprising the plug discharge port 54 are representatively illustrated. In the FIG. 9 example, the plug discharge port 54 has an oblong or oval shape. The piston 58 is in its open position, so that the seat 60, inclined surface 72 and bypass flow paths 82 are visible through the port 54. Note that the piston 58 in this example is similar to that of the FIG. 6 example, except that multiple bypass flow paths 82 are provided.

In the FIG. 10 example, the piston 58 is in its closed position blocking fluid flow through the port 54. The port 54 in this example has a "tear drop" shape, with the port being wider where it is anticipated the plug 70 will be discharged.

Figure 11:
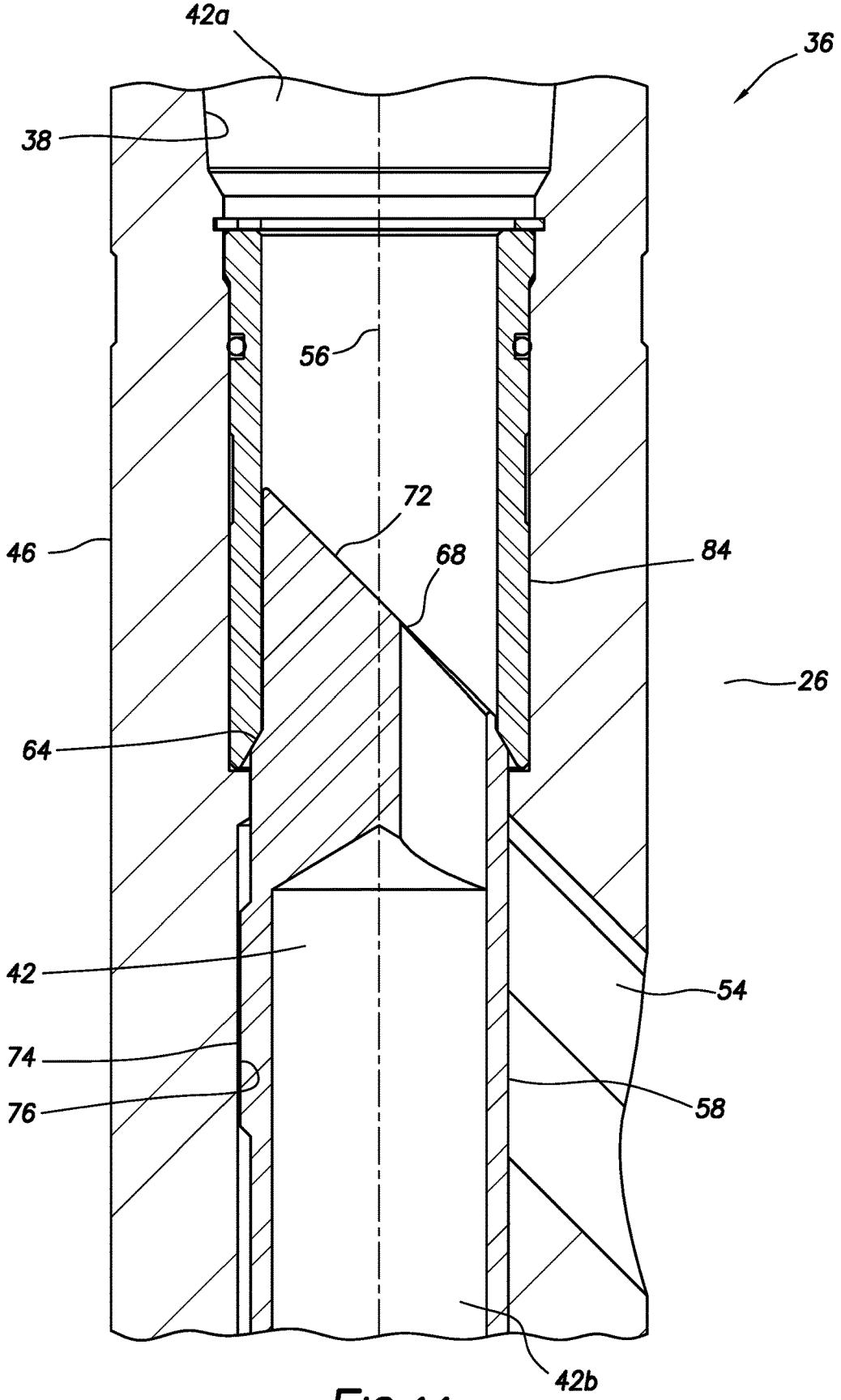
FIG. 11 is a representative cross-sectional view of another example of the dispenser portion.

Referring additionally now to FIG. 11, another example of the plug dispenser section of the plug dispenser tool 36 is representatively illustrated. The FIG. 11 example is substantially similar to the FIG. 4 example. However, in the FIG. 11 example, the upper seal 64 comprises metal-to-metal sealing engagement between the piston 58 and an insert sleeve 84 sealingly received in the outer housing 46. The biasing device 60 biases the piston 58 into metal-to-metal sealing contact with the insert sleeve 84 when the piston is in the closed position. The FIG. 11 metal-to-metal seal 64 may be used in place of any of the seals 64, 66 of any of the examples of the plug dispenser tool 36 described herein.

Figure 12:
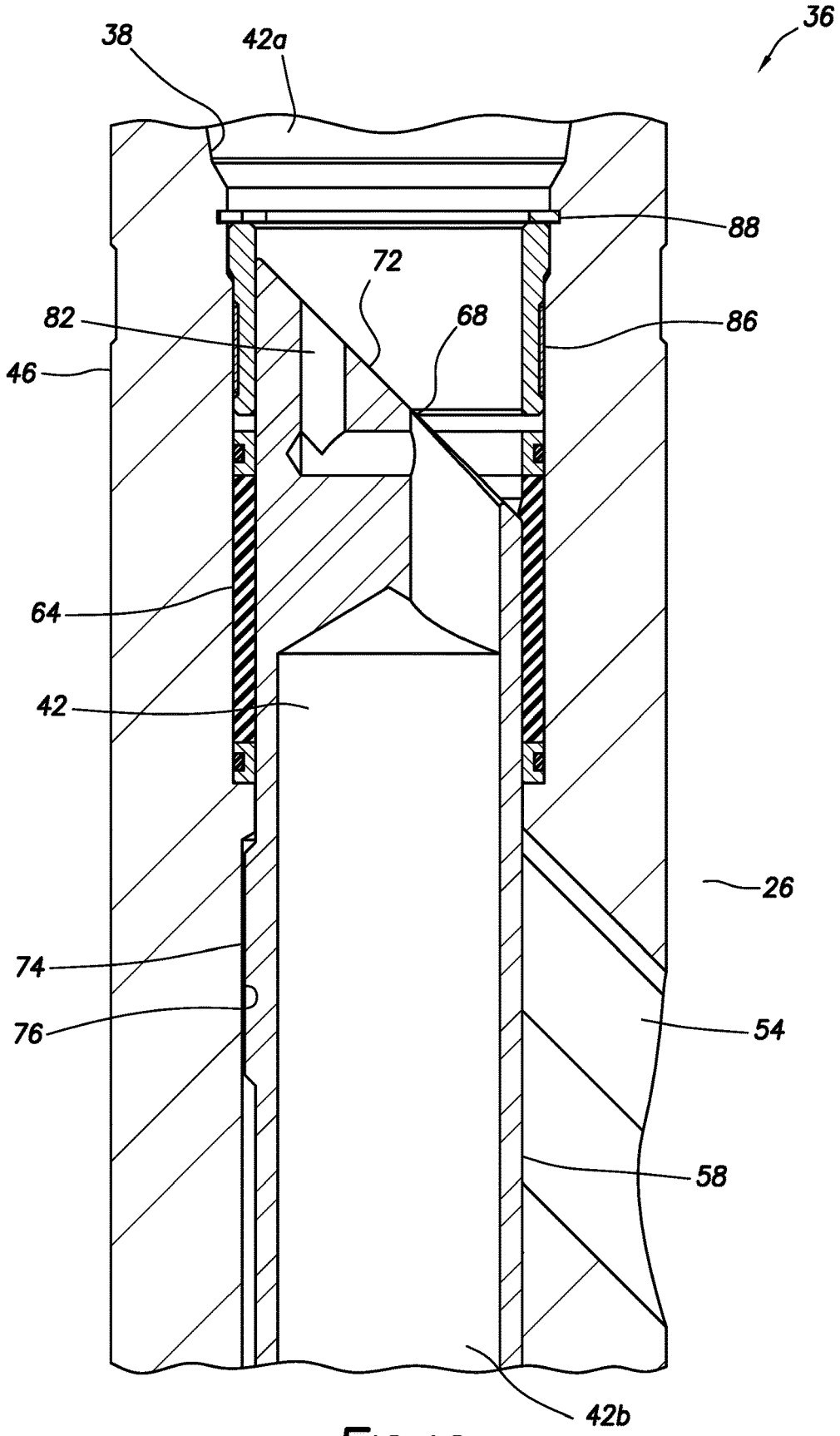
FIG. 12 is a representative cross-sectional view of another example of the dispenser portion.

Referring additionally now to FIG. 12, another example of the plug dispenser section of the plug dispenser tool 36 is representatively illustrated. In the FIG. 12 example, the upper seal 64 comprises a molded annular seal. The molded annular seal 64 is retained in the outer housing 46 using a sleeve 86 and a retainer ring 88. The FIG. 12 molded annular seal 64 may be used in place of any of the seals 64, 66 of any of the examples of the plug dispenser tool 36 described herein.

In each of the examples described above, the plug 70 is discharged from the plug dispenser tool 36 when a predetermined pressure differential is applied across the plug in the tool and the piston 58 is displaced to its open position. After the plug 70 is discharged, the biasing device 60 will displace the piston 58 back to its closed position. If it is desired to discharge another plug 70 from the tool 36, the additional plug can be deployed into the tubular string 12, engaged with the seat 68, and the pressure differential can again be applied to discharge the additional plug from the tool. This process can be repeated in order to discharge as many plugs 70 as is desired from the tool 36.

It may now be fully appreciated that the above disclosure provides significant advancements to the art of deploying plugging devices in a well. In various examples described above, a plug 70 can be discharged from the plug dispenser tool 36 downhole by applying a pressure differential across the plug in the tool. Any desired number of plugs 70 can be discharged from the tool 36.

The above disclosure provides to the art a method of dispensing at least one plug 70 into a wellbore 14. In one example, the method can comprise: deploying the plug 70 into a tubular string 12 including a plug dispenser tool 36; and applying a pressure differential across the plug 70, thereby discharging the plug 70 from the plug dispenser tool 36 via a discharge port 54 into an annulus 26 surrounding the plug dispenser tool 36.

The method may include, after the plug 70 deploying step, engaging the plug 70 with a seat 68 of the plug dispenser tool 36, thereby blocking fluid flow 44 through the seat 68.

The pressure differential applying step may include displacing a piston 58 of the plug dispenser tool 36, thereby permitting fluid flow 44 through the discharge port 54.

A longitudinal flow passage 42 of the plug dispenser tool 36 may extend through the piston 58. The plug 70 deploying step may include blocking fluid flow 44 through the flow passage 42.

The piston 58 may include a seat 68 encircling the flow passage 42. The fluid flow 44 blocking step may include the plug 70 contacting the seat 68.

The piston displacing step may include overcoming a biasing force exerted by a biasing device 60.

The method may include connecting the plug dispenser tool 36 in the tubular string 12 between a proximal end of the tubular string 12 and a drill bit or a mill 20. The connecting step may include connecting a fluid motor 22 between the plug dispenser tool 36 and the drill bit or the mill 20.

Also provided to the art by the above disclosure is a plug dispenser tool 36 for dispensing at least one plug 70 into a subterranean well. In one example, the plug dispenser tool 36 comprises: an outer housing 46 having a plug discharge port 54 that provides fluid communication between an exterior of the outer housing 46 and a flow passage 42 extending longitudinally through the plug dispenser tool 36; a piston 58 slidably disposed in the outer housing 46 between a closed position in which the piston 58 blocks fluid flow 44 through the plug discharge port 54, and an open position in which fluid flow 44 through the plug discharge port 54 is permitted; and a biasing device 60 that biases the piston 58 toward the closed position.

The piston 58 may include a seat 68 configured to engage the plug 70 so that fluid flow 44 through the seat 68 is blocked when the plug 70 engages the seat 68. The seat 68 may be inclined relative to a central longitudinal axis 56 of the plug dispenser tool 36. The seat 68 may be inclined and face toward the discharge port 54 in the open position of the piston 58.

A bypass flow path 82 may provide fluid communication between a first section 42*a* of the flow passage 42 on one side of the seat 68 and a second section 42*b* of the flow passage 42 on an opposite side of the seat 68.

Rotation of the piston 58 in the outer housing 46 may be limited.

The biasing device 60 may comprise a coiled compression spring.

The above disclosure also describes a system 10 for use with a subterranean well. In one example, the system 10 can comprise: a plug dispenser tool 36 connected in a tubular string 12 and deployed into the well, the plug dispenser tool 36 including an openable plug discharge port 54; and a plug 70 deployed into the tubular string 12, the plug 70 being configured to block fluid flow 44 through the plug dispenser tool 36. The plug dispenser tool 36 is configured to discharge the plug 70 via the plug discharge port 54 into an annulus 26 surrounding the plug dispenser tool 36 in response to a predetermined pressure differential applied across the plug 70.

The tubular string 12 may include a drill bit and/or a mill 20. A fluid motor 22 may be connected between the plug dispenser tool 36 and the drill bit and/or the mill 20.

The plug dispenser tool 36 may include a piston 58 having a seat 68 encircling a longitudinal flow passage 42. The piston 58 may block the plug discharge port 54 in a closed position, and displacement of the plug 70 through the plug discharge port 54 may be permitted in an open position. A surface 72 of the piston 58 surrounding the seat 68 may be inclined toward the plug discharge port 54.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of dispensing at least one plug into a wellbore, the method comprising:

deploying the plug into a tubular string including a plug dispenser tool;

applying a pressure differential across the plug, thereby opening a discharge port of the plug dispenser tool; and discharging the plug from the plug dispenser tool via the discharge port into an annulus surrounding the plug dispenser tool.

2. The method of claim 1, further comprising, after the plug deploying, engaging the plug with a seat of the plug dispenser tool, thereby blocking fluid flow through the seat.

3. The method of claim 1, in which the pressure differential applying further comprises displacing a piston of the plug dispenser tool, thereby permitting fluid flow through the discharge port.

4. The method of claim 3, in which a longitudinal flow passage of the plug dispenser tool extends through the piston, and in which the plug deploying further comprises blocking fluid flow through the flow passage.

5. The method of claim 4, in which the piston includes a seat encircling the flow passage, and in which the fluid flow blocking comprises the plug contacting the seat.

6. The method of claim 3, in which the piston displacing comprises overcoming a biasing force exerted by a biasing device.

7. The method of claim 1, further comprising connecting the plug dispenser tool in the tubular string between a proximal end of the tubular string and a selected one of the group consisting of a drill bit and a mill.

8. The method of claim 7, in which the connecting further comprises connecting a fluid motor between the plug dispenser tool and the selected one of the group consisting of the drill bit and the mill.

9. A plug dispenser tool for dispensing at least one plug into a subterranean well, the plug dispenser tool comprising:

an outer housing having a plug discharge port that provides fluid communication between an exterior of the outer housing and a flow passage extending longitudinally through the plug dispenser tool;

a piston slidably disposed in the outer housing between a closed position in which the piston blocks fluid flow through the plug discharge port, and an open position in which fluid flow through the plug discharge port is permitted; and a biasing device that biases the piston toward the closed position.

10. The plug dispenser tool of claim 9, in which the piston includes a seat configured to engage the plug so that fluid flow through the seat is blocked when the plug engages the seat.

11. The plug dispenser tool of claim 10, in which the seat is inclined relative to a central longitudinal axis of the plug dispenser tool.

12. The plug dispenser tool of claim 10, in which the seat is inclined and faces toward the plug discharge port in the open position of the piston.

13. The plug dispenser tool of claim 10, in which a bypass flow path provides fluid communication between a first section of the flow passage on one side of the seat and a second section of the flow passage on an opposite side of the seat.

14. The plug dispenser tool of claim 9, in which rotation of the piston in the outer housing is limited.

15. The plug dispenser tool of claim 9, in which the biasing device comprises a coiled compression spring.

16. A system for use with a subterranean well, the system comprising:

a plug dispenser tool connected in a tubular string and deployed into the well, the plug dispenser tool including an openable plug discharge port; and a plug deployed into the tubular string, the plug being configured to block fluid flow through the plug dispenser tool, and the plug dispenser tool being configured to discharge the plug via the plug discharge port into an annulus surrounding the plug dispenser tool in response to a predetermined pressure differential applied across the plug.

17. The system of claim 16, in which the tubular string includes a selected one of a drill bit and a mill.

18. The system of claim 17, in which a fluid motor is connected between the plug dispenser tool and the selected one of the drill bit and the mill.

19. The system of claim 16, in which the plug dispenser tool includes a piston having a seat encircling a longitudinal flow passage, and in which the piston blocks the plug discharge port in a closed position of the piston, and displacement of the plug through the plug discharge port is permitted in an open position of the piston.

20. The system of claim 19, in which a surface of the piston surrounding the seat is inclined toward the plug discharge port.

* * * * *